US010967222B2

(12) United States Patent
Amrozowicz et al.

(10) Patent No.: US 10,967,222 B2
(45) Date of Patent: Apr. 6, 2021

(54) ELECTRONICALLY ASSISTED SPEED TRAINER

(71) Applicants: Paul D. Amrozowicz, Gilbert, AZ (US); Thomas Scott Dennis, Phoenix, AZ (US)

(72) Inventors: Paul D. Amrozowicz, Gilbert, AZ (US); Thomas Scott Dennis, Phoenix, AZ (US)

( * ) Notice: Subject to any disclaimer, the term of this patent is extended or adjusted under 35 U.S.C. 154(b) by 226 days.

(21) Appl. No.: 16/207,987

(22) Filed: Dec. 3, 2018

(65) Prior Publication Data

US 2020/0171351 A1 Jun. 4, 2020

(51) Int. Cl.
*A63B 24/00* (2006.01)
*A43B 5/06* (2006.01)

(52) U.S. Cl.
CPC ..... *A63B 24/0062* (2013.01); *A43B 5/06* (2013.01); *A63B 24/0003* (2013.01); *A63B 2220/12* (2013.01); *A63B 2220/34* (2013.01); *A63B 2225/50* (2013.01)

(58) Field of Classification Search
CPC .... A63B 24/0062; A63B 2220/12; A43B 5/06
USPC ..... 36/132
See application file for complete search history.

(56) References Cited

U.S. PATENT DOCUMENTS

| | | | | |
|---|---|---|---|---|
| 6,257,548 | B1 * | 7/2001 | Hiddessen | F16K 3/18 251/129.06 |
| 9,597,567 | B1 * | 3/2017 | Tran | A63B 60/16 |
| 2011/0131839 | A1 * | 6/2011 | Ballin | A43B 13/186 36/141 |
| 2015/0025816 | A1 * | 1/2015 | Ross | A43B 17/00 702/44 |
| 2019/0076716 | A1 * | 3/2019 | Chiou | G08B 25/016 |

* cited by examiner

*Primary Examiner* — Timothy K Trieu
(74) *Attorney, Agent, or Firm* — Lorenz & Kopf, LLP

(57) ABSTRACT

A footwear impulse-momentum device includes a first momentum actuator, a second momentum actuator, a position sensor, and a processing system, which are dimensioned to fit within a shoe sole. The first momentum actuator is coupled to receive a first control signal and is configured, upon receipt thereof, to move between a first position and a second position. The second momentum actuator is coupled to receive a second control signal and is configured, upon receipt thereof, to move between a third position and a fourth position spaced. The position sensor is configured to sense a position of the sole of the shoe and supply a shoe position signal representative thereof. The processing system is configured to receive the shoe position signal and is operable, in response thereto, to selectively generate and supply the first and second control signals to the first and second momentum actuators, respectively.

19 Claims, 8 Drawing Sheets

ELECTRONICALLY ASSISTED SPEED TRAINER

TECHNICAL FIELD

The present disclosure generally relates to an athletic running, walking, and hiking speed trainer, and more particularly relates to an electronically assisted speed trainer.

BACKGROUND

Running, in both competitive and recreational contexts, continues to gain in popularity. Regardless of a person's skill level, running is basically a series of rotations—leaping off one foot and landing again on the other. In this regard, running can be viewed as a series of falls, aided by gravity and management of angular velocity. Stated another way, when a person runs, they fall forward, and their fall is limited by their legs.

Many competitive and recreational runners seek to improve their running techniques, to thereby improve their running times and efficiencies. Many techniques concentrate on arm movement. This is because it is widely recognized that a runner's arms may act as a counterbalance, and may yield up to a 10 percent improvement with proper technique. Other techniques concentrate on the vertical components associated with running. However, as just noted, running is highly rotational based. Yet, very few, if any running improvement techniques or devices concentrate on angular energy management of the feet.

Hence, there is a need for a device that provides improvement in running capabilities that concentrates on angular energy foot management. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a footwear impulse-momentum device includes a first momentum actuator, a second momentum actuator, a position sensor, and a processing system. The first and second momentum actuators are dimensioned to fit within a sole of a shoe. The first momentum actuator is coupled to receive a first control signal and is configured, upon receipt of the first control signal, to move between a first position and a second position. The second momentum actuator is spaced apart from the first momentum actuator. The second momentum actuator is coupled to receive a second control signal and is configured, upon receipt of the second control signal, to move between a third position and a fourth position spaced. The position sensor is dimensioned to fit within the sole of the shoe, and is configured to sense a position of the sole of the shoe and supply a shoe position signal representative thereof. The processing system is in operable communication with the first momentum actuator, the second momentum actuator, and the position sensor. The processing system is configured to receive the shoe position signal and is operable, in response thereto, to selectively generate and supply the first and second control signals to the first and second momentum actuators, respectively.

In another embodiment, a footwear impulse-momentum device includes a first momentum actuator, a second momentum actuator, a third momentum actuator, a fourth momentum actuator, a piezoelectric strip, a position sensor, and a processing system. The first momentum actuator is dimensioned to fit within a sole of a shoe, and is coupled to receive a first control signal and is configured, upon receipt of the first control signal, to move between a first position and a second position. The second momentum actuator is dimensioned to fit within the sole of the shoe and is spaced apart from the first momentum actuator. The second momentum actuator is coupled to receive a second control signal and is configured, upon receipt of the second control signal, to move between a third position and a fourth position spaced. The third momentum actuator is dimensioned to fit within the sole of the shoe and disposed adjacent the first momentum actuator. The third momentum actuator is coupled to receive a third control signal and is configured, upon receipt of the third control signal, to move between a fifth position and a sixth position. The fourth momentum actuator is dimensioned to fit within the sole of the shoe and is disposed adjacent the second momentum actuator. The fourth momentum actuator is coupled to receive a fourth control signal and is configured, upon receipt of the fourth control signal, to move between a seventh position and an eighth position. The piezoelectric strip is electrically coupled to, and extends between, the first momentum actuator, the second momentum actuator, the third momentum actuator, and the fourth momentum actuator. The position sensor is dimensioned to fit within the sole of the shoe, and is configured to sense a position of the sole of the shoe and supply a shoe position signal representative thereof. The processing system is in operable communication with the first momentum actuator, the second momentum actuator, the third momentum actuator, the fourth momentum actuator, and the position sensor. The processing system is configured to receive the shoe position signal and operable, in response thereto, to selectively generate and supply the first, second, third, and fourth control signals to the first, second, third, and fourth momentum actuators, respectively.

In yet another embodiment, a shoe includes a shoe upper, a sole coupled to the shoe upper, a first momentum actuator, a second momentum actuator, a piezoelectric strip, a position sensor, and a processing system. The first momentum actuator is disposed within the sole. The first momentum actuator is coupled to receive a first control signal and is configured, upon receipt of the first control signal, to move between a first position and a second position. The second momentum actuator is disposed within the sole and is spaced apart from the first momentum actuator. The second momentum actuator is coupled to receive a second control signal and is configured, upon receipt of the second control signal, to move between a third position and a fourth position spaced. The piezoelectric strip is disposed within the sole and is configured as a strip spring. The piezoelectric strip is electrically coupled to, and extends between, the first and second momentum actuators. The position sensor is disposed within the sole, and is configured to sense a position of the shoe and supply a shoe position signal representative thereof. The processing system is in operable communication with the first momentum actuator, the second momentum actuator, and the position sensor. The processing system is configured to receive the shoe position signal and operable, in response thereto, to selectively generate and supply the first and second control signals to the first and second momentum actuators, respectively.

Furthermore, other desirable features and characteristics of the claimed device will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
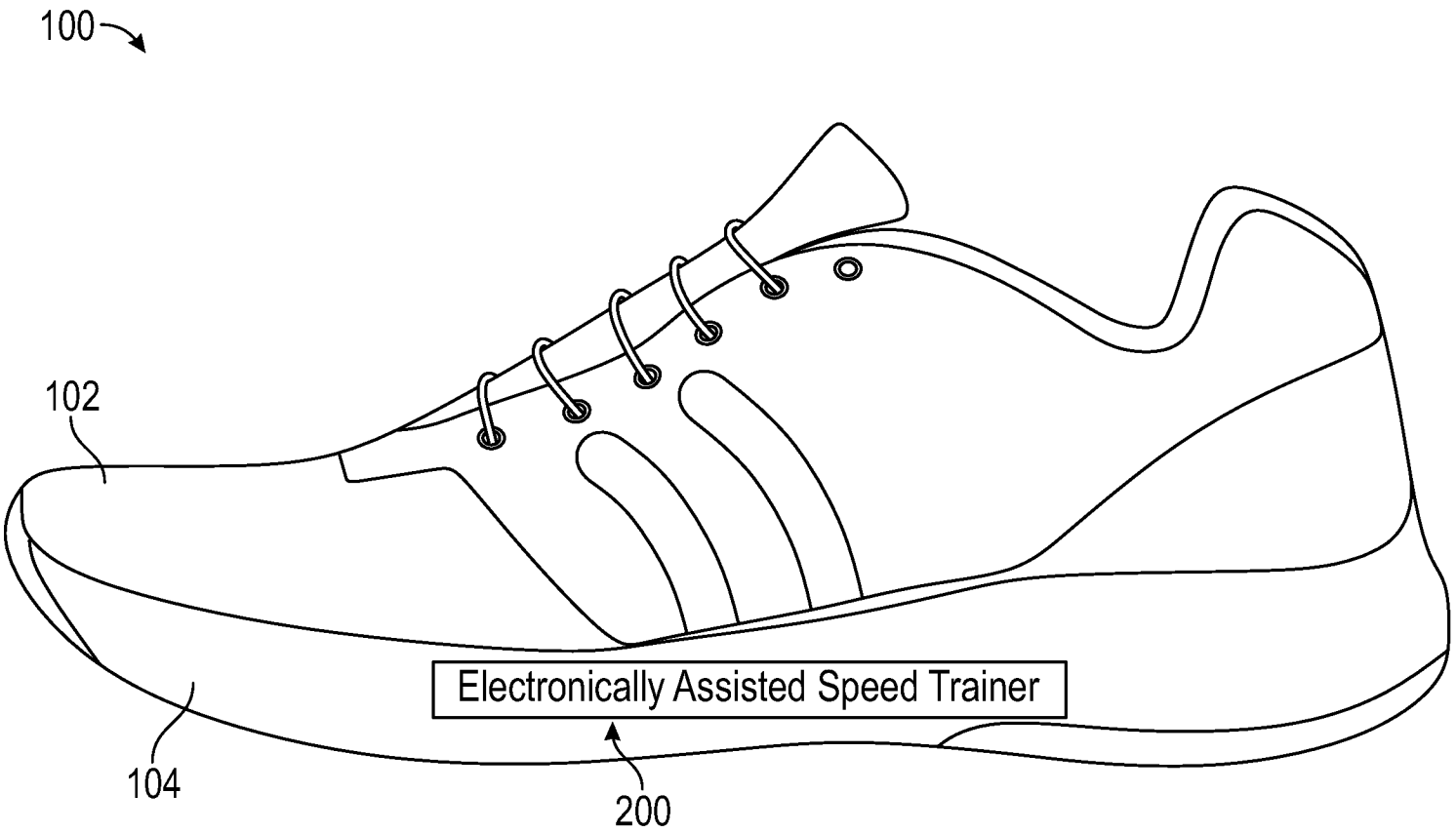
FIG. 1 depicts a simplified side view of a running shoe having an electronically assisted speed trainer disposed therein.

Referring first to FIG. 1, a side view of a running shoe 100 is depicted. The shoe 100 has a toe end 101 and a heel end 103, and like many other shoes, includes a shoe upper 102, and a sole 104 that is coupled to the shoe upper 102. The sole 104, as shown schematically in FIG. 1, has a footwear impulse-momentum device 200, also referred to herein as an electronically assisted speed trainer 200, disposed therein. It will be appreciated that the electronically assisted speed trainer 200 may be disposed in the sole 104 before or after the sole 104 is coupled to the upper 102. It may also be formed as part of the shoe 100 during its manufacture, or disposed in a post-manufactured shoe 100 in a manner that will allow removal and replacement of all or portions of the electronically assisted speed trainer 200.

Figure 2:
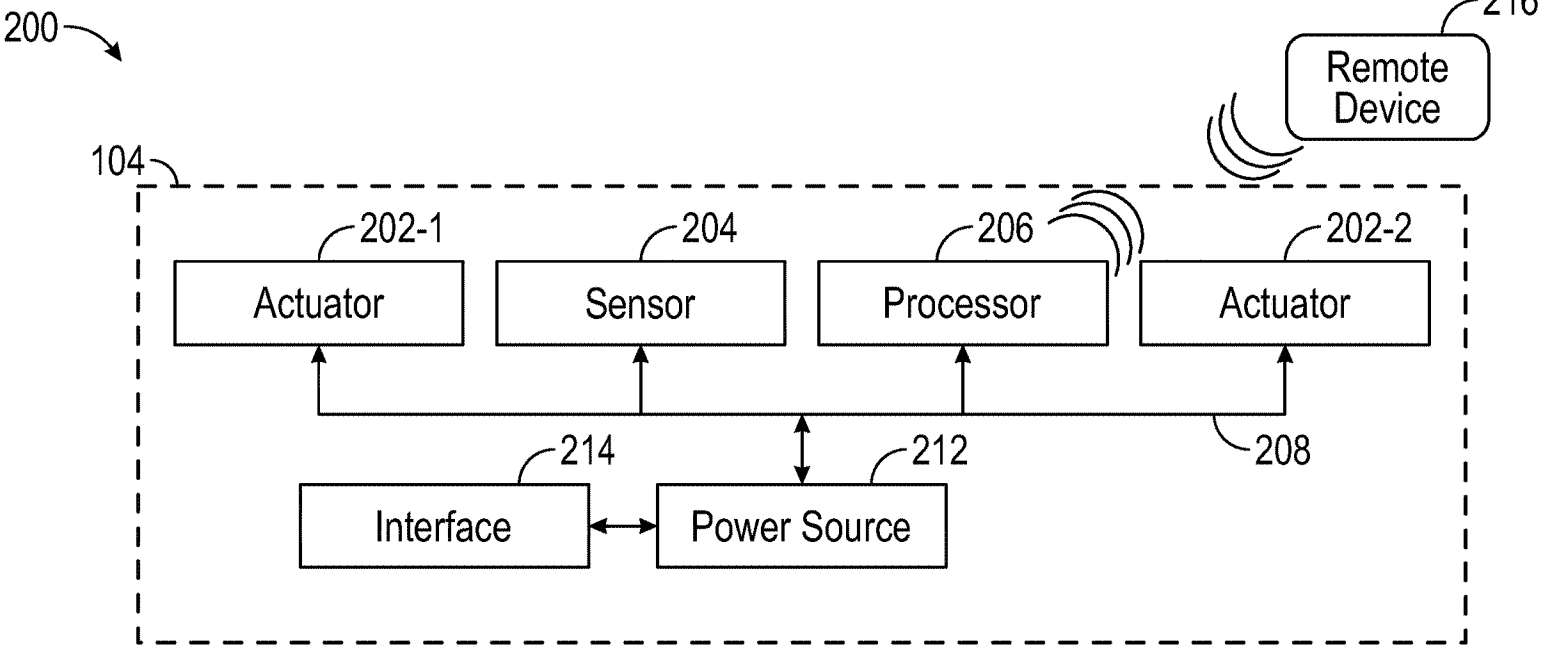
FIG. 2 depicts one embodiment of an electronically assisted speed trainer that may be disposed within the shoe of FIG. 1.

Regardless of when and how the electronically assisted speed trainer 200 is disposed in the shoe 100, and with reference now to FIG. 2, it includes at least a plurality of momentum actuators 202, one or more position sensors 204 (only one depicted in FIG. 1), and a processing system 206, all of which are disposed within the sole 104. In the depicted embodiment, the electronically assisted speed trainer 200 includes at least two momentum actuators—a first momentum actuator 202-1 and a second momentum actuator 202-2. However, in other embodiments, some of which are described further below, the electronically assisted speed trainer 200 could include more than this number of momentum actuators 202.

The momentum actuators 202 are each responsive to individual control signals to move between different positions. More specifically, the first momentum actuator 202-1 is coupled to receive a first control signal and is configured, upon receipt of the first control signal, to move between a first position and a second position. The second momentum actuator 202-2 is coupled to receive a second control signal and is configured, upon receipt of the second control signal, to move between a third position and a fourth position spaced. Preferably, the first momentum actuator 202-1 is disposed proximate the toe end 101 of the shoe 100, and the second momentum actuator 202-2 is disposed proximate the heel end 103 of the shoe 100.

Figure 3:
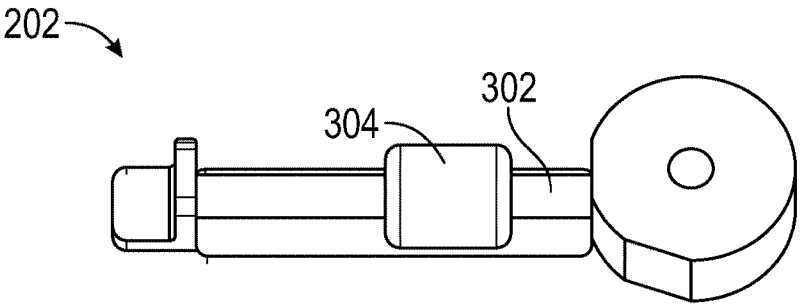
FIG. 3 depicts one embodiment of a momentum actuator that may be used to implement the electronically assisted speed trainer of FIG. 2.

It will be appreciated that the momentum actuators 202 may be implemented using any one of numerous types of actuators. For example, the momentum actuators may each comprise a voice coil actuator or solenoid actuator. In one particular embodiment, and as shown more clearly in FIG. 3, each momentum actuator 202 includes at least one solenoid actuator 302 and at least one movable mass 304. With this configuration, the solenoid actuator 302 is coupled to receive the control signal and, in response, generates an electromagnetic force. The electromagnetic force in turn causes the movable mass 304 to move to the desired position. In other embodiments, which are described further below, each momentum actuator 202 may include two or more solenoids 302 and two or more moving masses 304.

Returning to FIG. 2, the position sensor 204 is configured to sense a position of the shoe 100, and supply a shoe position signal representative thereof to the processing system 206. The position sensor 204 may be implemented using any one of numerous types of position sensing devices. For example, it may be implemented using any one of numerous types of accelerometers. In one embodiment, however, the position sensor 204 comprises one or more accelerometers. It will be appreciated that although the embodiment depicted in FIG. 1 depicts only one position sensor 204, the electronically assisted speed trainer 200 could be implemented with a plurality of position sensors 204, with each sensor 204 being associated with a different one of the momentum actuators 202 (for example). Moreover, although shown separate from the processing system 206, it will be appreciated that the one or more position sensors 204 could be collocated with the processing system 206 ad/or integrally formed as part of the processing system 206.

The processing system 206 is in operable communication with at least each of the momentum actuators 202 and the position sensor 204. The processing system 206 is coupled to receive the shoe position signal from the position sensor 204 and is operable, in response thereto, to selectively generate and supply the first and second control signals to the first and second momentum actuators 202, respectively. In this manner, when the shoe 100 is disposed on the foot of a person, the electronically assisted speed trainer 200 enhances the angular acceleration of the foot just prior to, and immediately following, the ground strike. More specifically, the processing system 206 will selectively supply the control signals to the momentum actuators 202, based on the sensed position of the foot, in order to accelerate the foot slightly forward of the natural rotation just prior to foot strike, and slightly higher in the rearward direction following the push-off, thereby achieving further lift for the next stroke.

Figure 4:
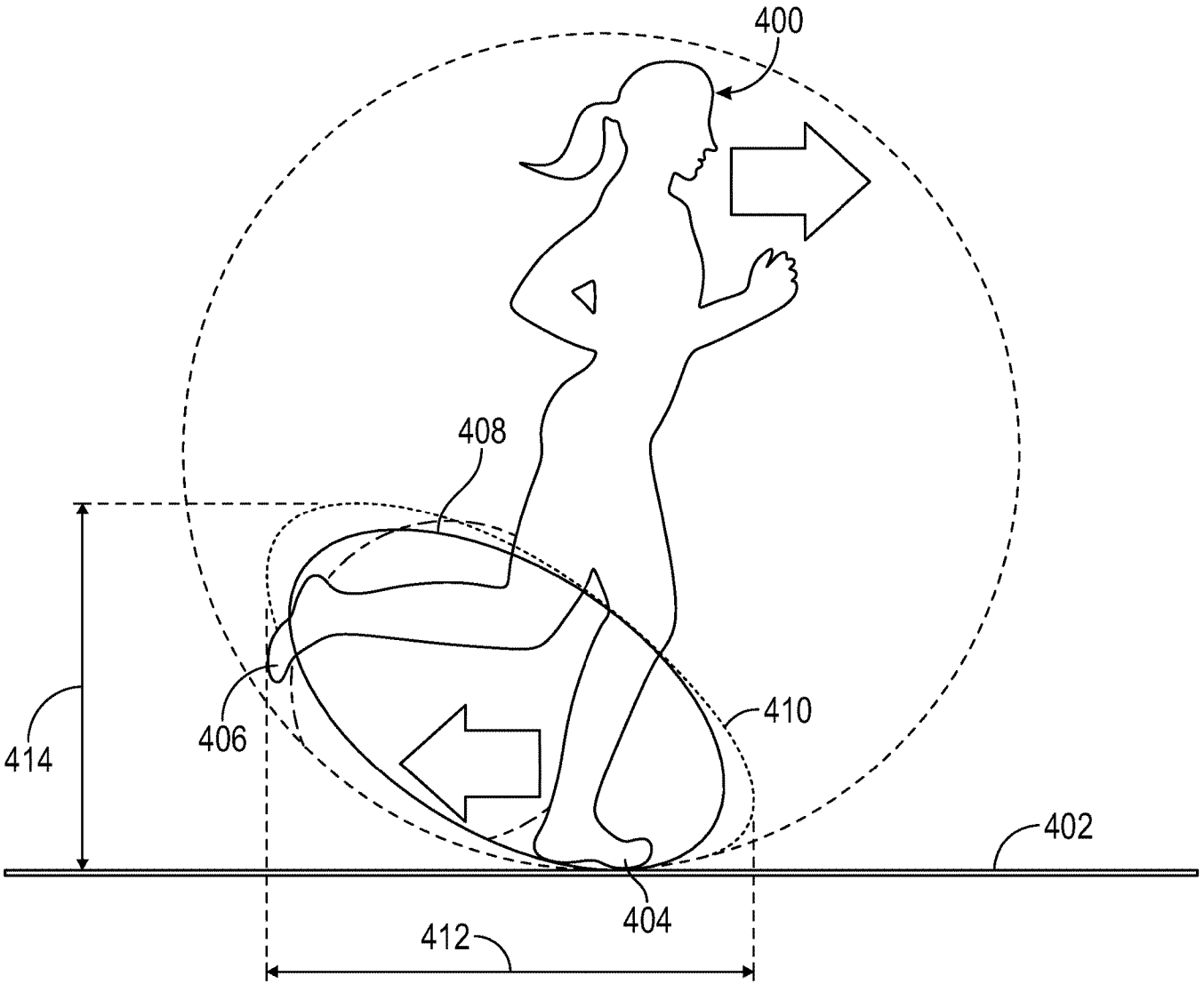
FIG. 4 depicts a runner in mid-stride on a running surface to illustrate the effects of the electronically assisted speed trainer disclosed herein.

The above-described functionality is depicted more clearly in FIG. 4, which depicts a runner 400 in mid-stride on a running surface 402, with one foot 404 striking the running surface 402 and ready to push off, and the other foot 406 in its rear-most position ready to rotate forward. Also illustrated are the natural (i.e., unassisted) foot rotational path 408 for the runner 400, and the assisted foot rotational path 410 for the runner 400—in which each of the runner's shoes 100 includes the electronically assisted speed trainer 200. As FIG. 4 illustrates, the electronically assisted speed trainer 200 provides at least increased stride distance 412 and increased potential energy 414 of the feet at the rear-most position.

Before proceeding further, it is noted that the processing system 206 generally represents the hardware, software, and/or firmware components configured to facilitate communications and/or interaction between the elements of the electronically assisted speed trainer 200 and perform additional tasks and/or functions to support operation of the electronically assisted speed trainer 200, as described herein. Depending on the embodiment, the processing system 206 may be implemented or realized with a general-purpose processor, a content addressable memory, a digital signal processor, an application specific integrated circuit, a field programmable gate array, any suitable programmable logic device, discrete gate or transistor logic, processing core, discrete hardware components, or any combination thereof, designed to perform the functions described herein. The processing system 206 may also be implemented as a combination of computing devices, e.g., a plurality of processing cores, a combination of a digital signal processor and a microprocessor, a plurality of microprocessors, one or more microprocessors in conjunction with a digital signal processor core, or any other such configuration. In practice, the processing system 206 includes processing logic that may be configured to carry out the functions, techniques, and processing tasks associated with the operation of the system 100, as described in greater detail below. Furthermore, the steps of a method or algorithm described in connection with the embodiments disclosed herein may be embodied directly in hardware, in firmware, in a software module executed by the processing system 206, or in any practical combination thereof. For example, in one or more embodiments, the processing system 206 includes or otherwise accesses a data storage element (or memory), which may be realized as any sort of non-transitory short or long-term storage media capable of storing programming instructions for execution by the processing system 206. The code or other computer-executable programming instructions, when read and executed by the processing system 206, cause the processing system 206 to support or otherwise perform certain tasks, operations, functions, and/or processes described herein.

Returning now to FIG. 2, it is seen that the momentum actuators 202, the position sensor(s) 204, and the processing system 206 are in operable communication with each other via a conductor 208. Although the conductor 208 may be variously configured and implemented, in the depicted embodiment it is a piezoelectric strip 208. The piezoelectric strip 208 is, as its name implies, comprised at least partially of a piezoelectric material. In one particular embodiment, the piezoelectric strip 208 is also configured as a strip spring. As such, it will undergo flexural distortion when, for example, a wearer of the shoe 100 is running. As a result, and as is known for piezoelectric materials, it will generate electrical power. This electric power may be used, at least in part, to power the momentum actuators 202, the position sensor 204, and the processing system 206. As is also generally known, the stiffness of the piezoelectric strip 208 may be varied by varying electrical power supplied thereto.

In addition to, or instead of, the electrical power supplied by the piezoelectric strip 208, the electronically assisted speed trainer 200 may, in some embodiments, include a rechargeable power source 212. The rechargeable power source 212, if included, is preferably implemented using a rechargeable battery, and is also dimensioned to fit within the sole 104 of the shoe 100. The rechargeable power source 212 is electrically coupled to at least the momentum actuators 202, the position sensor 204, the processing system 206, and, when included, the piezoelectric strip 208. The electronically assisted speed trainer 200 may be configured with a suitable interface 214, such as a USB interface, to allow for charging/recharging of the rechargeable power source 212. In some embodiments, the electronically assisted speed trainer 200 may instead or additionally be configured to implement wireless charging/recharging of the rechargeable power source.

As FIG. 2 further depicts, in some embodiments the processing system 206 is additionally configured for wireless communication with a remote device 216. When so configured, the processing system 206 is preferably configured to receive, via wireless communication with the remote device 216, a plurality of user-editable settings, and to transmit, via wireless communication with the remote device 216, a plurality of performance parameters to the remote device 216. The remote device 216 may be variously configured and implemented. For example, it may be laptop or desktop computer, a tablet or other hand-held computer, a smartphone, or a smartwatch, just to name a few. In a particular embodiment, the remote device 216 is a smartphone and/or smartwatch that is configured to run an application ("app") unique to the electronically assisted speed trainer 200. The application will include a suitable user interface to allow a user to implement various functions, which will be described further below.

Figure 5:
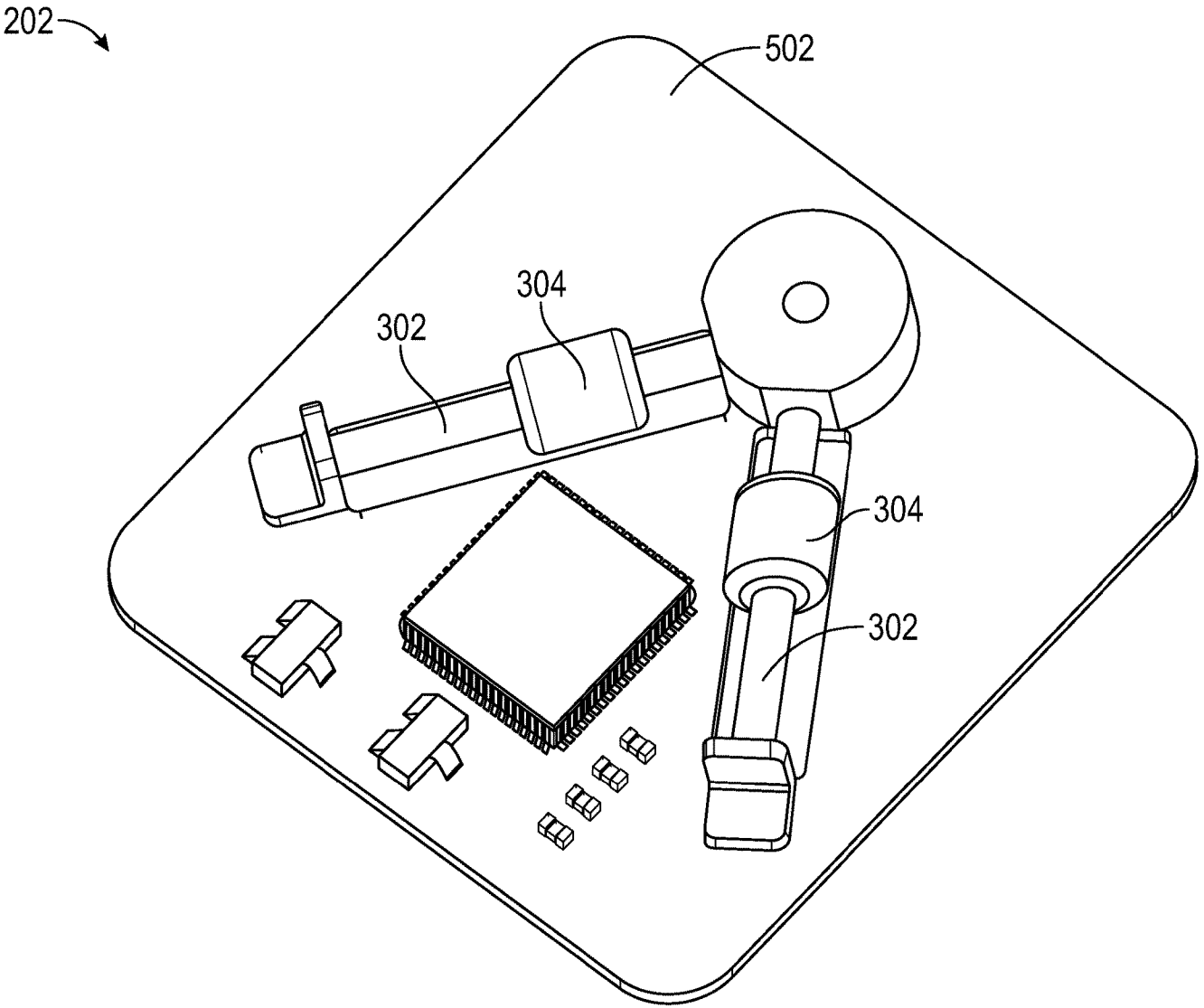
FIGS. 5 and 6 depict other example embodiments of momentum actuators that may be used to implement the electronically assisted speed trainer of FIG. 2.
Figure 6:
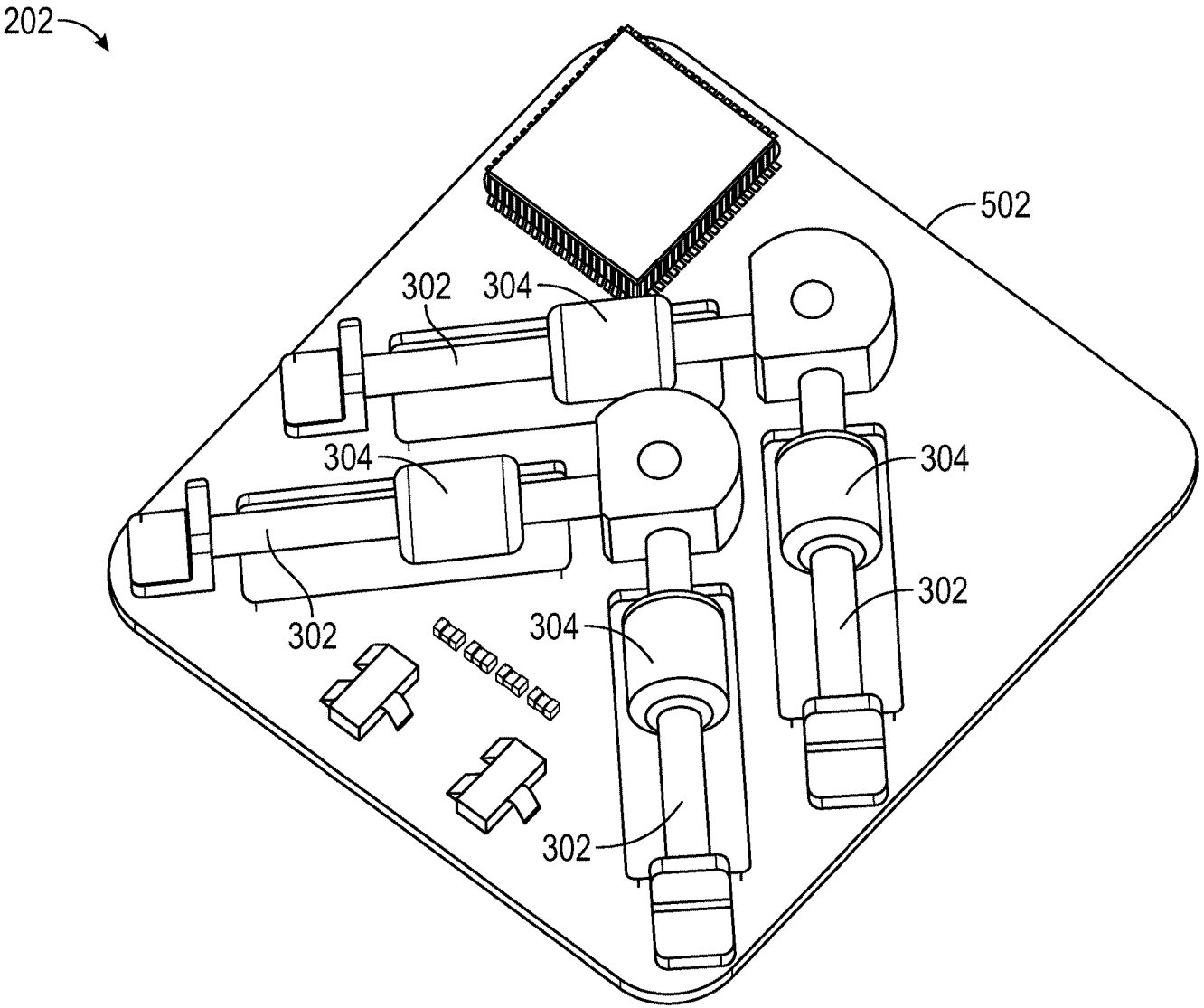

It was previously noted that each momentum actuator 202 may include two or more solenoids 302 and two or more moving masses 304. Indeed, in one particular physical implementation, which is shown in FIG. 5, the depicted momentum actuator includes two solenoids 302 (e.g., 302-1, 302-2) and two moving masses 304 (304-1, 304-2). In another particular physical implementation, which is shown in FIG. 6, the depicted momentum actuator includes four solenoids 302 (e.g., 302-1, 302-2, 302-3, 302-4) and four moving masses 304 (304-1, 304-2, 304-3, 304-4). In both embodiments, the momentum actuator 202 is disposed on a suitable substrate 502, such as a printed circuit board, or the like.

It will be appreciated that the electronically assisted speed trainer 200 may be implemented, at least in some embodiments, with a mixture of momentum actuator configurations. For example, it may be implemented with one or more momentum actuators 202 that have two solenoids 302 and two moving masses 304, together with one or more momentum actuators 202 that have four solenoids 302 and four moving masses 304, as needed or desired. Indeed, in one embodiment, which is depicted in FIGS. 7 and 8, the electronically assisted speed trainer 200 includes three momentum actuators 202, disposed proximate the heel end 103 of the shoe 100, that each include two solenoids 302 and two moving masses 304, and two momentum actuators 202, disposed proximate the toe end 101 of the shoe 100, that each include four solenoids 302 and four moving masses 304.

Figure 7:
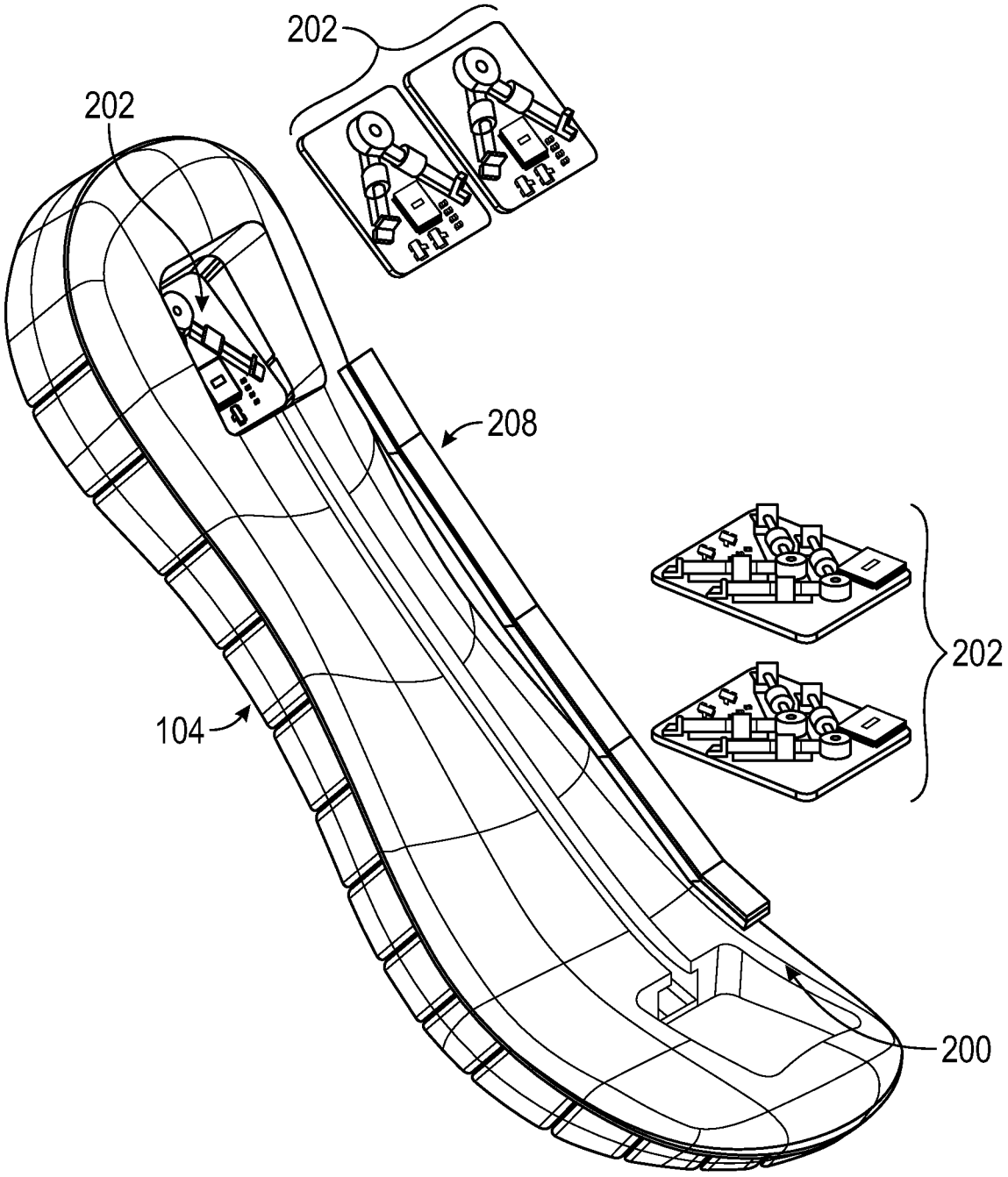
FIGS. 7 and 8 depict one example physical embodiment an embodiment of the electronically assisted speed trainer of FIG. 2 being disposed in the sole of a shoe.
Figure 8:
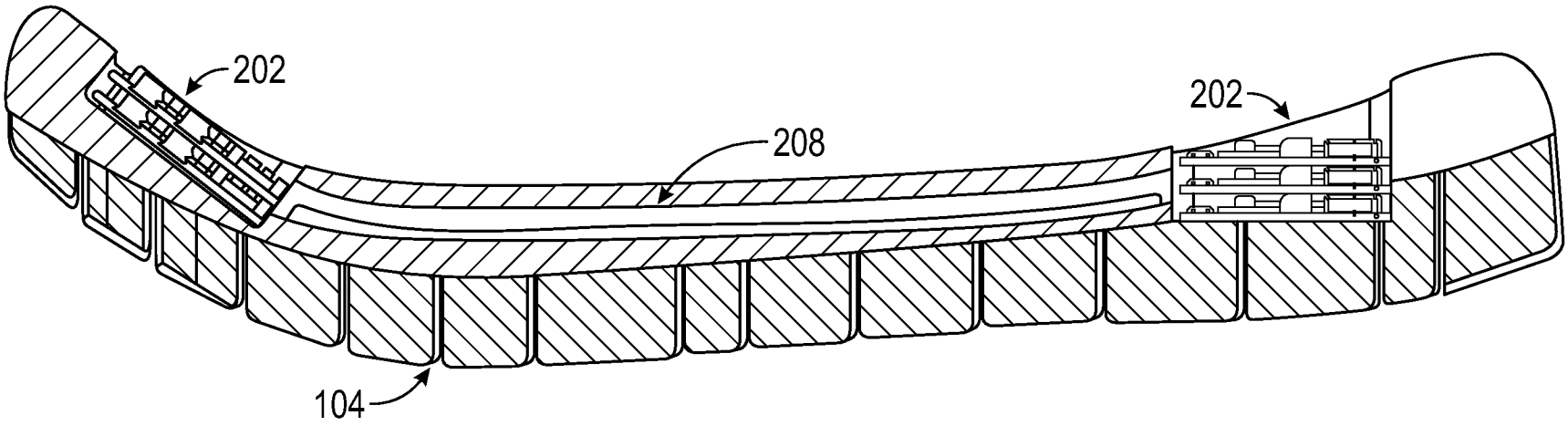

In the embodiment depicted in FIGS. 7 and 8, it should be noted that various circuit components are depicted as being disposed on the same substrate 502 as each of the momentum actuators 202. These circuit components may vary, and one or more may be position sensors 204 and/or comprise the processing system 206. This is merely one example embodiment, and in other embodiments the electronically assisted speed trainer 200 may be configured such that only one or more of the momentum actuators 202 has circuit components disposed on the same substrate.

Figure 9B:
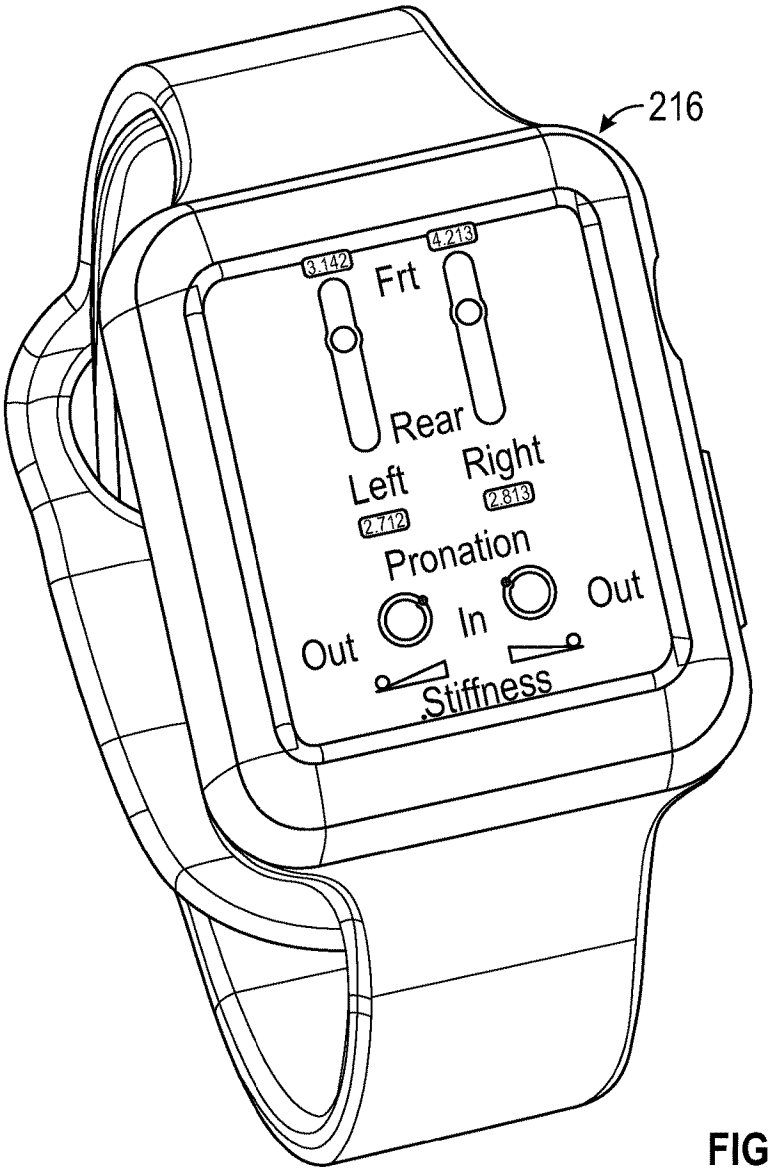
FIGS. 9A and 9B depict portions of user interfaces that may be implemented on remote devices that may form part of the electronically assisted speed trainer of FIG. 2.
Figure 9A:
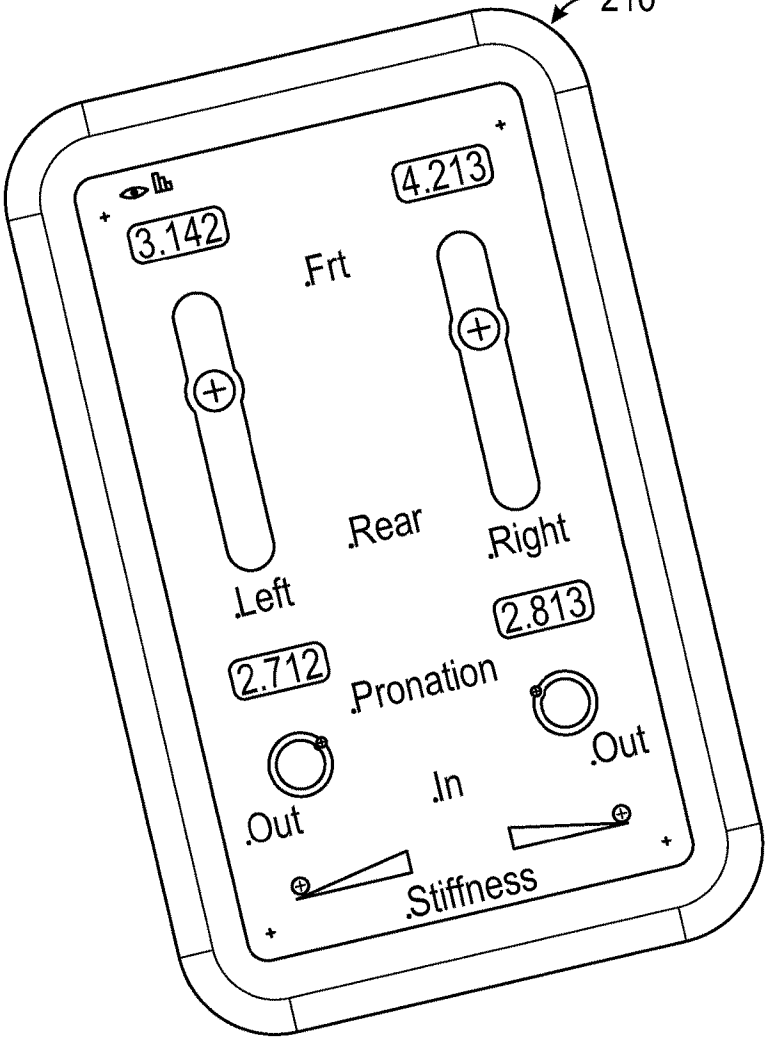

A competitive runner may average, for example, 180 steps per minute, whereas a recreational runner may average, for example, around 160 steps per minute (or less). The electronically assisted speed trainer 200 is configured to cover all ranges, from walking to elite running. As described above, the momentum actuators disposed in the sole 104 of the shoe 100 will accelerate the leading foot slightly forward of the natural rotation, and slightly higher rearward following the push-off, achieving further lift for the next stroke. As also described above, the electronically assisted speed trainer 200 may include a remote device 216, such as a smartphone and/or smartwatch, that is configured to run an application ("app") unique to the electronically assisted speed trainer 200. In one embodiment, which is depicted in FIG. 9, the user of the electronically assisted speed trainer 200 may configure the accelerations, via the app on the remote device 216, to be purely linear in the forward and rearward directions, or the user may configure the accelerations to be at a desired angle to correct pronation/supination. The operator may also, in some embodiments, select a desired sole stiffness, via the app on the remote device 216, for either comfort or performance by configuring the amount of electrical energy supplied to the piezo-electric strip 208.

For example, the piezoelectric strip 208 may be electronically actuated to provide its maximum stiffness at near the moment of push-off acting as a spring, assisting the user by minimizing losses and leading the event. With the additional leading foot and rearward lift accelerations and piezoelectric strip stiffness, the user can either run at a reduced energy input, to thereby achieve longer runs, or maintain their energy input and increase horizontal velocity, thereby reducing competitive times.

This electronically assisted speed trainer 200 is described herein as a device that runners may use to, for example, tune muscle-memory, enhance training, and improve confidence. The electronically assisted speed trainer 200 may also provide additional speed or longevity for military, police, and emergency personnel, or it may be used in medical rehabilitation (even prosthetics). Additional applications may be, but not limited to, bicycling (utilizing the forward impact-moment and piezo-stiffener aspects on the power stroke of the pedal revolution), hiking, walking, assisting the aged, and robotics.

The electronically assisted speed trainer provides improvement in running capabilities that concentrates on angular energy foot management. The disclosed trainer utilizes multiple simultaneous momentum actuations which result in an impulse-momentum force to guide an operator's foot rotation, coupled with piezo-electric on-board power generation and stiffness-control, which may be managed via wireless communication to enhance running, walking, or hiking.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general-purpose processor, a digital signal processing system (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processing system may be a microprocessor, but in the alternative, the processing system may be any conventional processor, controller, microcontroller, or state machine. A processing system may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processing system such that the processing system can read information from, and write information to, the storage medium. In the alternative, the storage medium may be integral to the processor. The processing system and the storage medium may reside in an ASIC.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processing system devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer-readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A footwear impulse-momentum device, comprising:

a first momentum actuator, the first momentum actuator dimensioned to fit within a sole of a shoe, the first momentum actuator coupled to receive a first control signal and configured, upon receipt of the first control signal, to move between a first position and a second position, to thereby impart momentum to the sole of the shoe in a first direction;

a second momentum actuator, the second momentum actuator dimensioned to fit within the sole of the shoe and spaced apart from the first momentum actuator, the second momentum actuator coupled to receive a second control signal and configured, upon receipt of the second control signal, to move between a third position and a fourth position spaced, to thereby impart momentum to the sole of the shoe in a second direction;

a position sensor, the position sensor dimensioned to fit within the sole of the shoe, the position sensor configured to sense a position of the sole of the shoe and supply a shoe position signal representative thereof; and a processing system, the processing system in operable communication with the first momentum actuator, the second momentum actuator, and the position sensor, the processing system configured to receive the shoe position signal and operable, in response thereto, to selectively generate and supply the first and second control signals to the first and second momentum actuators, respectively.

2. The device of claim 1, further comprising:

a piezoelectric strip electrically coupled to, and extending between, the first momentum actuator and the second momentum actuator, and further electrically coupled to the processing system and the position sensor.

3. The device of claim 1, further comprising:

a rechargeable power source, the rechargeable power source dimensioned to fit within the sole of the shoe, the rechargeable power source electrically coupled to at least the first and second momentum actuators, the piezoelectric strip, the position sensor, and the processing system.

4. The device of claim 1, wherein the first and second momentum actuators each comprise a solenoid and a moveable mass.

5. The device of claim 1, wherein the position sensor comprises one or more accelerometers.

6. The device of claim 1, wherein the processing system is configured for wireless communication with a remote device.

7. The device of claim 6, wherein the processing system is further configured to:

receive, via wireless communication with the remote device, a plurality of user-editable settings; and transmit, via wireless communication with the remote device, a plurality of performance parameters to the remote device.

8. The device of claim 1, wherein the piezoelectric strip is configured as a strip spring.

9. The device of claim 8, wherein the processing system is in operable communication with the third and fourth momentum actuators and is further operable, in response to the position signal, to selectively generate and supply the third and fourth control signals to the third and fourth momentum actuators, respectively.

10. The device of claim 1, further comprising:

a third momentum actuator, the third momentum actuator dimensioned to fit within the sole of the shoe and disposed adjacent the first momentum actuator, the third momentum actuator coupled to receive a third control signal and configured, upon receipt of the third control signal, to move between a fifth position and a sixth position, to thereby impart momentum to the sole of the shoe in the first direction;

a fourth momentum actuator, the fourth momentum actuator dimensioned to fit within the sole of the shoe and disposed adjacent the second momentum actuator, the fourth momentum actuator coupled to receive a fourth control signal and configured, upon receipt of the fourth control signal, to move between a seventh position and an eighth position, to thereby impart momentum to the sole of the shoe in the second direction.

11. A footwear impulse-momentum device, comprising:

a first momentum actuator, the first momentum actuator dimensioned to fit within a sole of a shoe, the first momentum actuator coupled to receive a first control signal and configured, upon receipt of the first control signal, to move between a first position and a second position, to thereby impart momentum to the sole of the shoe in a first direction;

a second momentum actuator, the second momentum actuator dimensioned to fit within the sole of the shoe and spaced apart from the first momentum actuator, the second momentum actuator coupled to receive a second control signal and configured, upon receipt of the second control signal, to move between a third position and a fourth position spaced, to thereby impart momentum to the sole of the shoe in a second direction;

a third momentum actuator, the third momentum actuator dimensioned to fit within the sole of the shoe and disposed adjacent the first momentum actuator, the third momentum actuator coupled to receive a third control signal and configured, upon receipt of the third control signal, to move between a fifth position and a sixth position, to thereby impart momentum to the sole of the shoe in the first direction;

a fourth momentum actuator, the fourth momentum actuator dimensioned to fit within the sole of the shoe and disposed adjacent the second momentum actuator, the fourth momentum actuator coupled to receive a fourth control signal and configured, upon receipt of the fourth control signal, to move between a seventh position and an eighth position, to thereby impart momentum to the sole of the shoe in the second direction;

a piezoelectric strip electrically coupled to, and extending between, the first momentum actuator, the second momentum actuator, the third momentum actuator, and the fourth momentum actuator;

a position sensor, the position sensor dimensioned to fit within the sole of the shoe, the position sensor configured to sense a position of the sole of the shoe and supply a shoe position signal representative thereof; and a processing system, the processing system in operable communication with the first momentum actuator, the second momentum actuator, the third momentum actuator, the fourth momentum actuator, and the position sensor, the processing system configured to receive the shoe position signal and operable, in response thereto, to selectively generate and supply the first, second, third, and fourth control signals to the first, second, third, and fourth momentum actuators, respectively.

12. The device of claim 11, further comprising:

a rechargeable power source, the rechargeable power source dimensioned to fit within the sole of the shoe, the rechargeable power source electrically coupled to at least the first, second, third, and fourth momentum actuators, the piezoelectric strip, the position sensor, and the processing system.

13. The device of claim 11, wherein the first, second, third, and fourth momentum actuators each comprise:

a solenoid actuator; and a movable mass.

14. The device of claim 11, wherein the position sensor comprises one or more accelerometers.

15. The device of claim 11, wherein the processing system is configured:

for wireless communication with a remote device;

to receive, via wireless communication with the remote device, a plurality of user-editable settings; and to transmit, via wireless communication with the remote device, a plurality of performance parameters to the remote device.

16. The device of claim 11, wherein the piezoelectric strip is configured as a strip spring.

17. A shoe, comprising:

a shoe upper;

a sole coupled to the shoe upper;

a first momentum actuator, the first momentum actuator disposed within the sole, the first momentum actuator coupled to receive a first control signal and configured, upon receipt of the first control signal, to move between a first position and a second position, to thereby impart momentum to the sole of the shoe in a first direction;

a second momentum actuator, the second momentum actuator disposed within the sole and spaced apart from the first momentum actuator, the second momentum actuator coupled to receive a second control signal and configured, upon receipt of the second control signal, to move between a third position and a fourth position spaced, to thereby impart momentum to the sole of the shoe in a second direction;

a piezoelectric strip disposed within the sole and configured as a strip spring, the piezoelectric strip electrically coupled to, and extending between, the first momentum actuator and the second momentum actuator;

a position sensor, the position sensor disposed within the sole, the position sensor configured to sense a position of the shoe and supply a shoe position signal representative thereof; and a processing system, the processing system in operable communication with the first momentum actuator, the second momentum actuator, and the position sensor, the processing system configured to receive the shoe position signal and operable, in response thereto, to selectively generate and supply the first and second control signals to the first and second momentum actuators, respectively.

18. The device of claim 17, further comprising:

a rechargeable power source, the rechargeable power source dimensioned to fit within the sole of the shoe, the rechargeable power source electrically coupled to at least the first and second momentum actuators, the piezoelectric strip, the position sensor, and the processing system.

19. The device of claim 16, wherein the processing system is configured:

for wireless communication with a remote device;

to receive, via wireless communication with the remote device, a plurality of user-editable settings; and to transmit, via wireless communication with the remote device, a plurality of performance parameters to the remote device.

* * * * *